US011864674B1

(12) United States Patent
Speck

(10) Patent No.: US 11,864,674 B1
(45) Date of Patent: Jan. 9, 2024

(54) WINE GLASS HOLDER

(71) Applicant: Paul Speck, Windsor, CO (US)

(72) Inventor: Paul Speck, Windsor, CO (US)

( * ) Notice: Subject to any disclaimer, the term of this patent is extended or adjusted under 35 U.S.C. 154(b) by 257 days.

(21) Appl. No.: 17/207,658

(22) Filed: Mar. 20, 2021

(51) Int. Cl.

| | |
|---|---|
| ***B65D 85/44*** | (2006.01) |
| ***A47G 23/02*** | (2006.01) |
| ***A47G 23/06*** | (2006.01) |
| ***B65D 1/34*** | (2006.01) |

(52) U.S. Cl.
CPC ..... *A47G 23/0225* (2013.01); *A47G 23/06* (2013.01); *B65D 1/34* (2013.01)

(58) Field of Classification Search
CPC ..... B65D 1/34; A47G 23/0225; A47G 23/06; A47G 23/0208
USPC ..... 206/217, 218, 426, 480, 560, 565; 211/41.14, 71.01, 85.29, 88.01, 90.03, 211/106, 119; 248/302, 310, 311.3
See application file for complete search history.

(56) References Cited

U.S. PATENT DOCUMENTS

| | | | | |
|---|---|---|---|---|
| 1,925,540 A * | 9/1933 | Neuschotz | A47G 23/0208 | 211/74 |
| 4,589,556 A * | 5/1986 | Peretz | A47L 15/505 | 211/41.9 |
| 4,850,282 A * | 7/1989 | Postic | A47B 23/04 | 108/47 |
| 4,860,895 A * | 8/1989 | Iaslovits | A47G 23/0208 | 206/480 |
| 5,711,436 A * | 1/1998 | Moeller | A47G 23/0208 | 248/312.1 |
| 6,357,607 B1 * | 3/2002 | Wu | A47B 81/04 | 211/75 |
| 6,843,381 B2 * | 1/2005 | Wu | A47B 81/04 | 211/85.29 |
| 2019/0117001 A1 * | 4/2019 | Larney | A47B 81/04 | |

* cited by examiner

*Primary Examiner* — Luan K Bui
(74) *Attorney, Agent, or Firm* — Lewis M Brande; Law Office of Lewis Brande

(57) ABSTRACT

This invention discloses four novel devices for holding the Stemware glasses, especially wine glasses firmly with a tray in an upward position to prevent the glass from falling and preventing spillage of wind during transportation of the wine tray with one or multiple wine glasses. These devices can hold all kinds of stemware of any stem height and base size. Two devices made of a single piece of metal wire including a pair of metal springs, which provides freedom to slide the glass base beneath where a hook-like metal loop of the device is used to make a tight grip with the side of the tray. One embodiment can be a plastic clip with a central rubber clasping washer. One embodiment modifies a tray to have a plurality of transverse springs.

12 Claims, 14 Drawing Sheets

WINE GLASS HOLDER

CROSS REFERENCE TO RELATED APPLICATIONS

This non provisional application claims priority to provisional application No. 62/914,570 which is incorporated herein by reference in its entirety.

FIELD OF THE INVENTION

This invention could be made of metal wire and a pair of springs, or a plastic embodiment for holding the base of a wine glass firmly in a serving tray, so the wine glass does not move from its position and wine cannot spill out of the glass while carrying the tray.

BACKGROUND OF THE INVENTION

This invention is for the serving and transporting of a glass of wine or any kind of stemware like a Champagne flute or a Champagne coup, and cocktail glasses. This device can be used to carry a glass full or empty, but this device is more useful when a glass is already full of wine. There are chances of spillage of wine, in this case, this glass will prevent falling off a tray when a large tray full of multiple wine glasses is transported.

This device is suitable for use in homes, boats, restaurants, and crowded get-together parties where a large amount of drinks is served in stemware glasses, for these places this device will be useful to hold the glass firmly within a tray.

One embodiment is made of metal wire and a pair of springs which enables this product to clip onto a tray and the base of the wine glass of any thickness. This device can hold glasses of all thickness of stems.

The closest known art is Pub. No. US2014/0339115 which provides a server tray with a central opening. A round perimeter has slots to carry wine glasses.

Serving trays have been used for centuries for carrying beverages, food, accessories, etc., and in modern times, used in many places including dining rooms, restaurants, bars, special events, and the like. There presently exist various inventions related to specialty trays developed for compartmentalizing the tray, for carrying specific items, and trays which are adapted for retaining glassware when the same is positioned thereon. The problem with these serving trays is that a user has to use both hands to carry such a tray and then set it down in order to serve customers or serve the items placed on the tray with one hand while having to balance the tray with their other hand. Sometimes attempts at this particular dexterity leads to spills and/or other accidents that can cost a business a lot of money for cleanup, glassware breakage, cleaning customer clothing and the like.

Perhaps one of the biggest problems with carrying items on a serving tray is the problem of limited space for a business or the like that serve beverages such as alcoholic beverages. When there is limited space, servers for a business or the like face the daunting problem of trying to balance items on their tray. This task can become even more difficult if a server bumps into a customer or another employee because of overcrowding. It is even more difficult for these servers to try and balance containers on their tray of the stemmed variety that hold alcoholic beverages such as wine. In the case of stemmed containers falling off a serving tray containing alcoholic beverages such as red wine, clean-up can be very messy because the wine can stain carpets, or even worse, stain the clothing of customers. Additionally, stemmed glassware that falls off a tray can create safety issues because broken glass can get all over the place and can be difficult to clean up and/or spot especially in a crowded room with dimmed lighting. Moreover, spilled wine can cost a business or the like a lot of money since a bottle of wine can be very expensive. Similarly, stemmed glassware can be very expensive to replace, especially if a business or the like uses high quality stemmed glassware to go along with the expensive wine they are serving.

There have been suggestions in the prior art of devices by which a user can hold a plate and a stemmed glass in one hand, leaving the other hand free. One suggestion is shown in Streames, UK Patent No. 1,126,304, which shows a relatively thin serving tray quite similar to a painter's pallet having a key hole slot at one end to hold a stemmed wine glass and at the other end a thumb hole. The user places their thumb through the thumb hole to the upper side of the tray and supports the bottom on the tray with the remaining fingers of the hand. The problem with this invention is that it allows a user to only carry one stemmed wine glass, and the thumb hole does not allow for even and stable gripping of the serving tray.

To more evenly distribute the weight of the tray and contents, grasping surfaces on the bottom of the tray have been proposed. U.S. Pat. Nos. 5,346,070 and 5,429,231 issued to McSpladden disclose a cup like portion for holding a drink container that is grasped by the user's hand to support the tray and contents but offers no solution for holding stemmed glassware. Moreover, holding the tray is not only tiring but also requires forearm inclination for maintaining proper horizontal orientation to avoid spillage. A further approach is disclosed in U.S. Pat. No. 6,264,026 issued to Bradley wherein a serrated conical handle is provided on the bottom surface of the tray for grasping by the user. The tray includes food areas and a single slotted glass holder for supporting stemmed glassware. The tray is adapted to be additionally supported by the forearm of the user. Nonetheless, the handle must be tightly and continuously grasped to prevent wobbling about the longitudinal or roll axis.

U.S. Pat. No. 4,219,144 issued to Gabriella Hagelberg describes a serving tray with a number of recesses in the form of bowls for components of a meal. A recess is provided for at least one dish and one is provided for a drinking vessel. A hole extends through Hagelberg's tray in a shape and size to form an opening for the insertion of the thumb of a hand so that the tray can be carried with the thumb on the upper side of the tray while the hand is placed under the tray bottom to support the underside of the tray. However, the thumb hole is in a corner to allow the hand to go under the tray and is not balanced at all. Finally, it is not left hand/right hand symmetrical.

U.S. Pat. No. 4,516,685 issued to Michael French sets forth a plate-type tray with a tapered plate section and a single slotted glass holder for supporting stemmed glassware. No provision is made for carrying a separate plate therein nor is there a provision for a thumb recess nor is there right hand/left hand interchangeability.

To further overcome the above difficulties and disadvantages, various serving trays for holding both food and drinks with a single hand have been proposed. U.S. Pat. No. 3,401,858 issued to White discloses a service tray wherein a pair of openings are included in a rear wall of the tray to enable a user to hold both the tray and a beverage container. The cantilevered weight is borne entirely by the user's wrist. A similar tray is disclosed in U.S. Pat. No. 5,429,266 issued to D'Oliveira wherein the user grips an end portion of a tray having discrete areas for nesting a beverage glass and a food plate. The weight is also borne entirely by the user's wrist and requires constant gripping pressure. Further, any inadvertent wrist movement can result in instability or spillage.

BRIEF SUMMARY OF THE INVENTION

The first embodiment is made of mostly a single piece of metal wire that carries a metal wire of thickness of 5 mm; preferably cross-section metal wire can be round or square. The metal wire is bent at the right-angle multiple times in such a way that it forms a hook-like structure, which can be used to mount on one side of the tray. The tray should have side boundaries, this invention is designed to fit properly with all the trays in the market. A related embodiment uses a two-wire clip.

A second embodiment is a one-piece plastic clip with a central rubber like recess port.

A third embodiment is a tray with a plurality of transverse springs.

A fourth embodiment uses a metal clip fastened at the bottom of the tray.

What is needed in the art is an accessory for a traditional serving tray having four sides. The present invention provides three embodiments of a clip-on wire glass holder. Another embodiment simply modifies a tray with a plurality of transverse springs between which a glass stem is inserted.

The novel design of these devices, provides freedom to hold all kinds of stemware with varying thickness, with or without decorations.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

The invention, together with further advantages thereof, may best be understood by reference to the following description taken in conjunction with the accompanying drawings in which.

Figure 1:
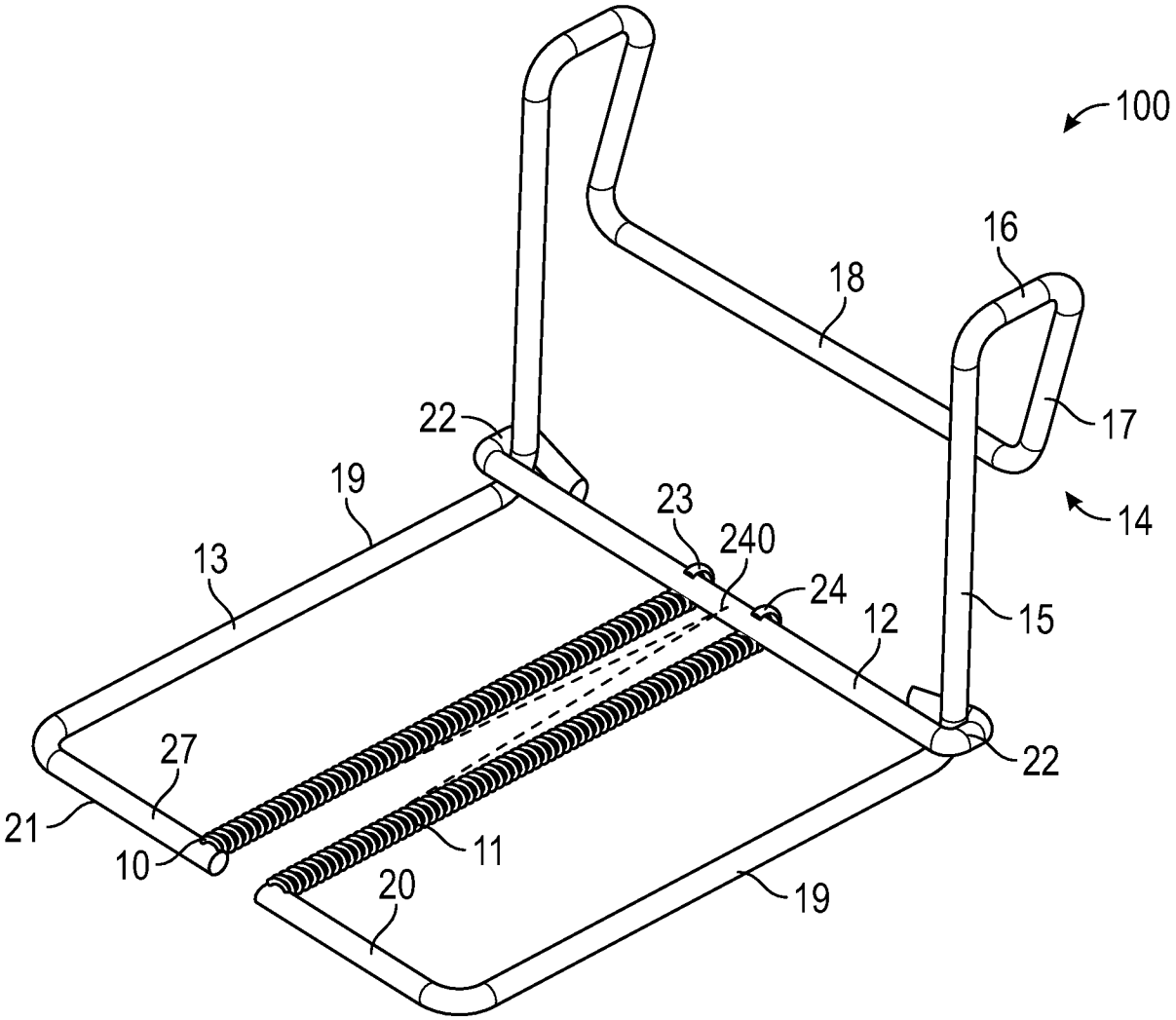
FIG. 1 is a top view of the first embodiment wine glass holder.
Figure 2:
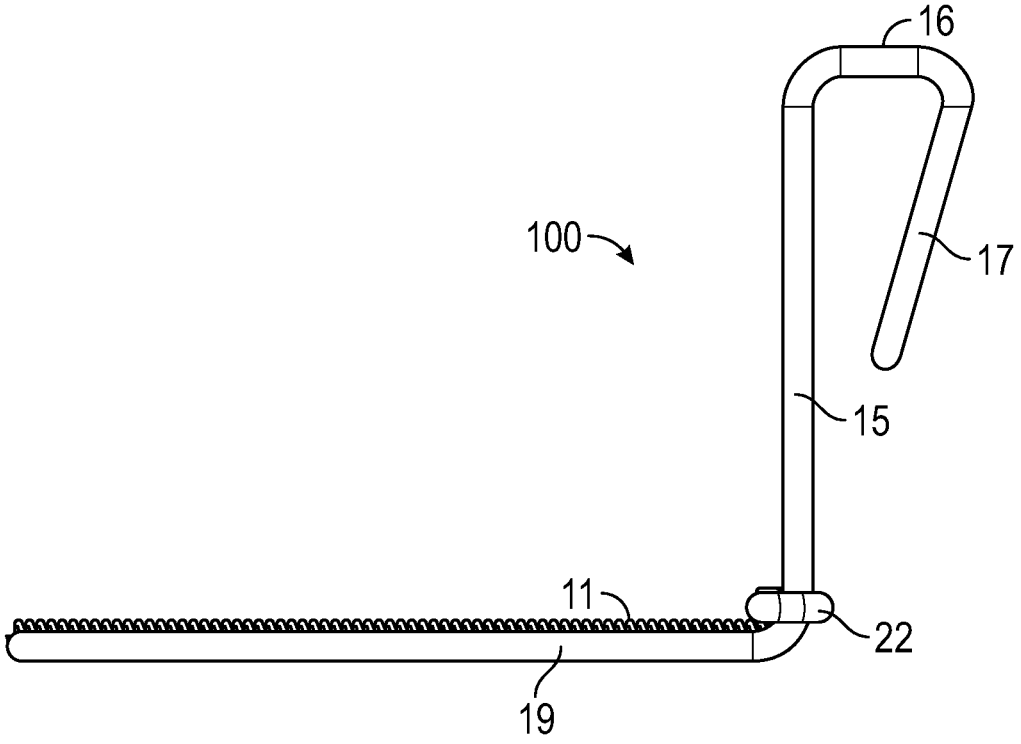
FIG. 2 is a right-side elevation view.
Figure 3:
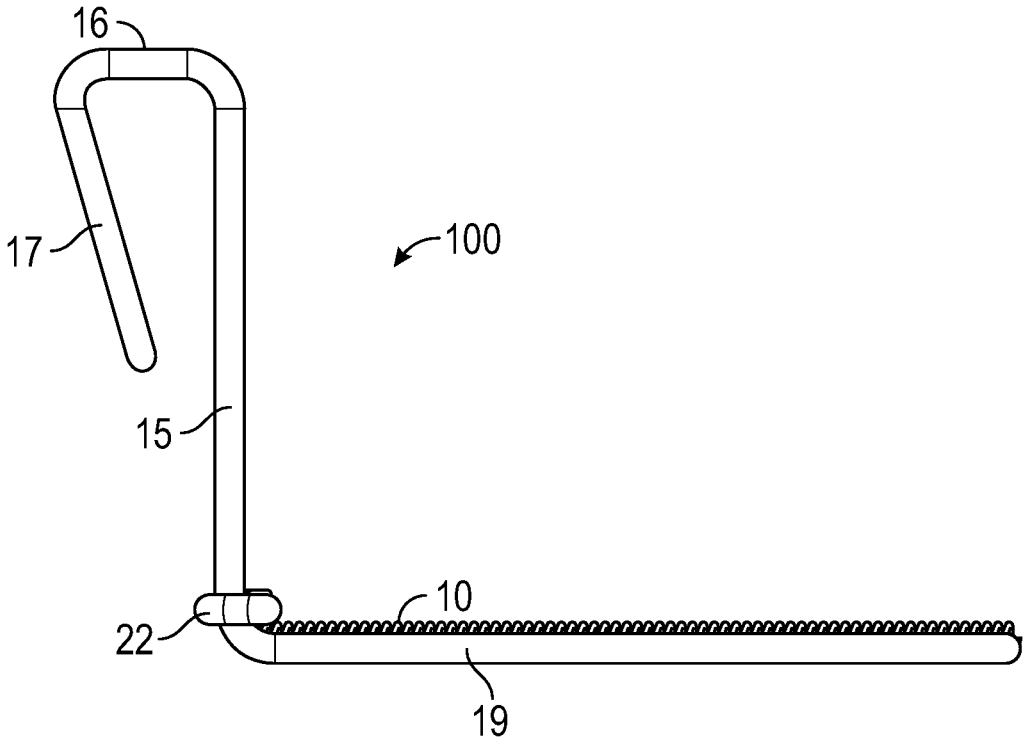
FIG. 3 is a left-side elevation view.
Figure 4:
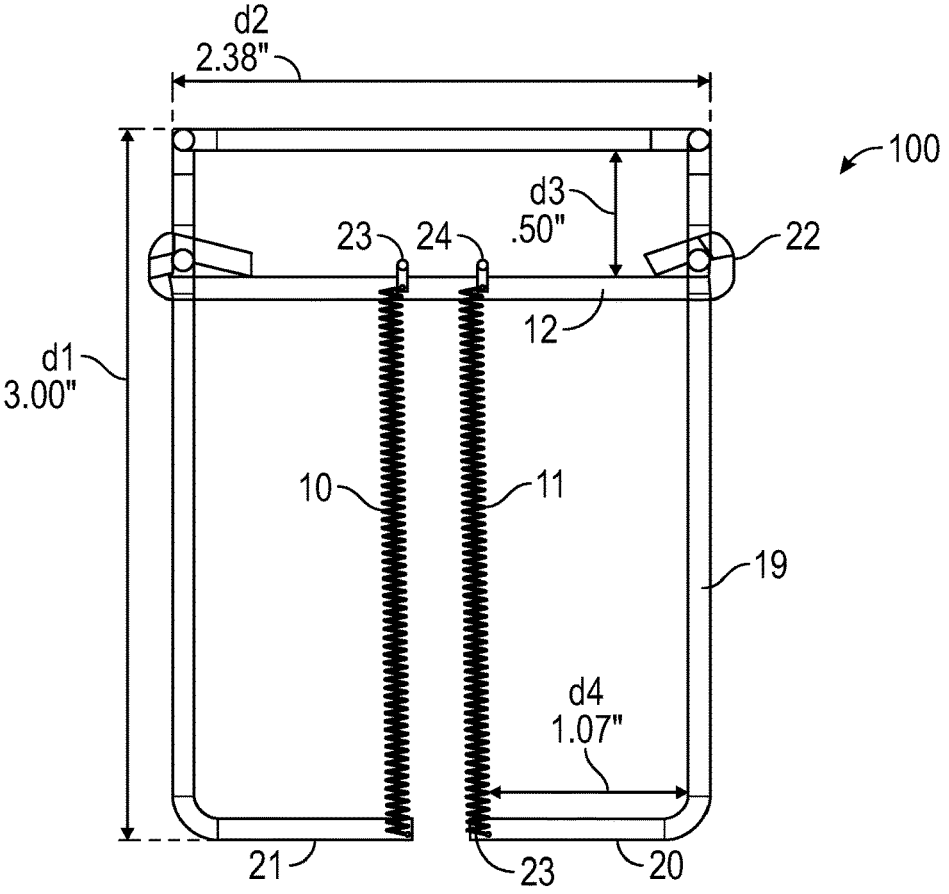
FIG. 4 is a top plan view.
Figure 5:
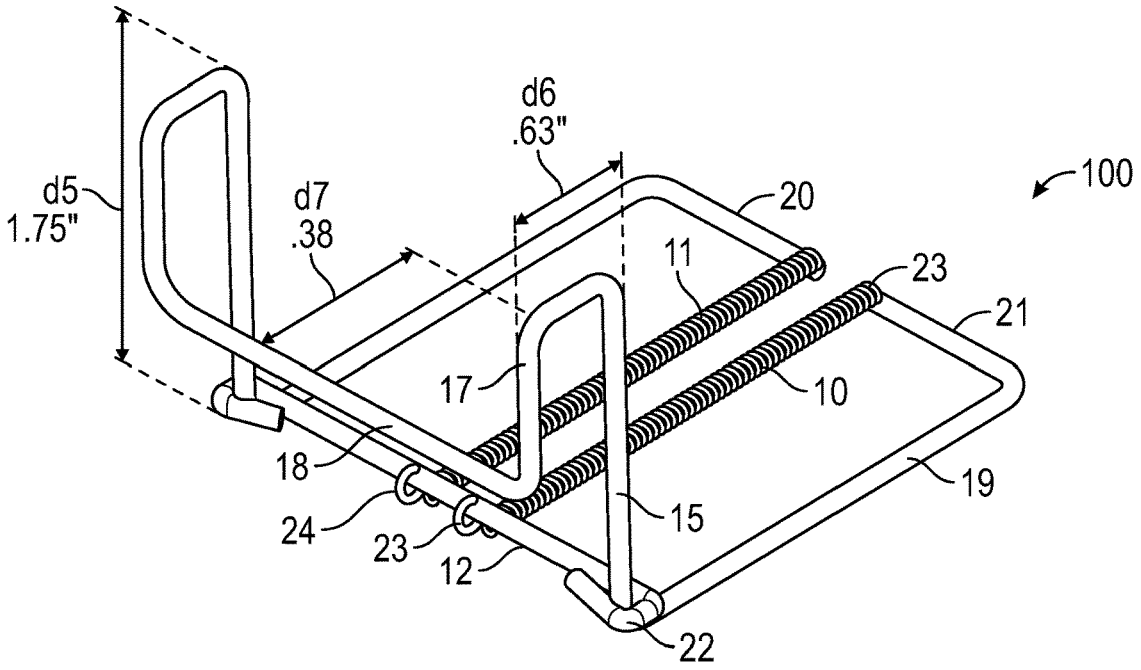
FIG. 5 is a rear perspective view.
Figure 6:
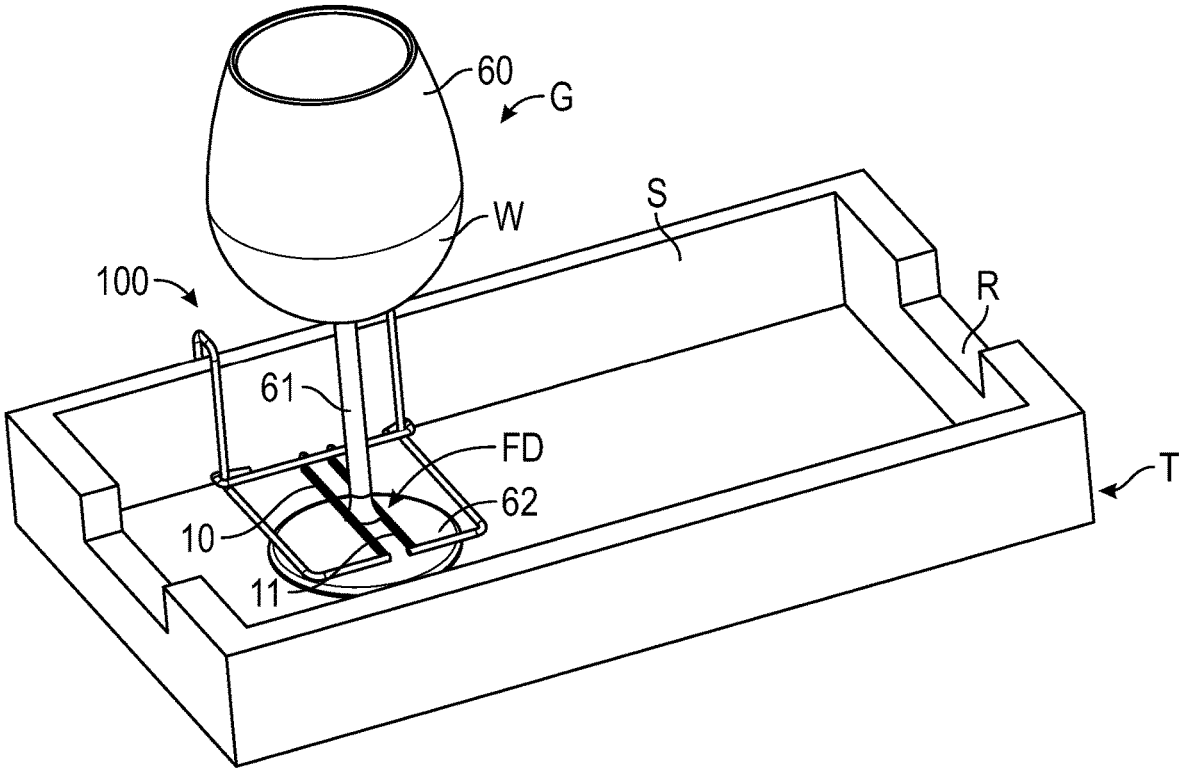
FIG. 6 is a perspective view of the wine glass holder attached to the tray.
Figure 7:
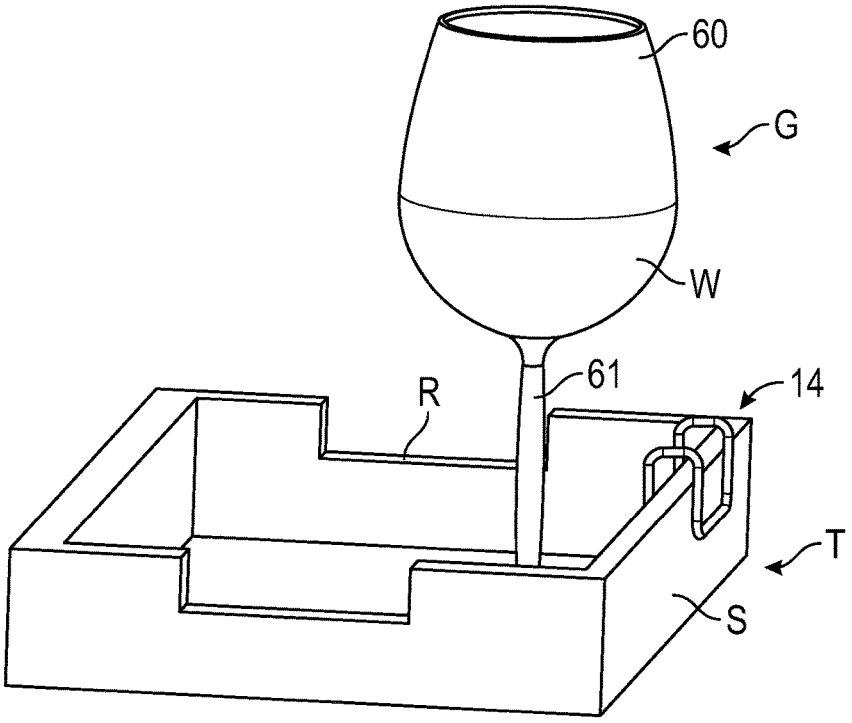
FIG. 7 is a right-side perspective view of the wine glass holder attached to the tray.
Figure 8:
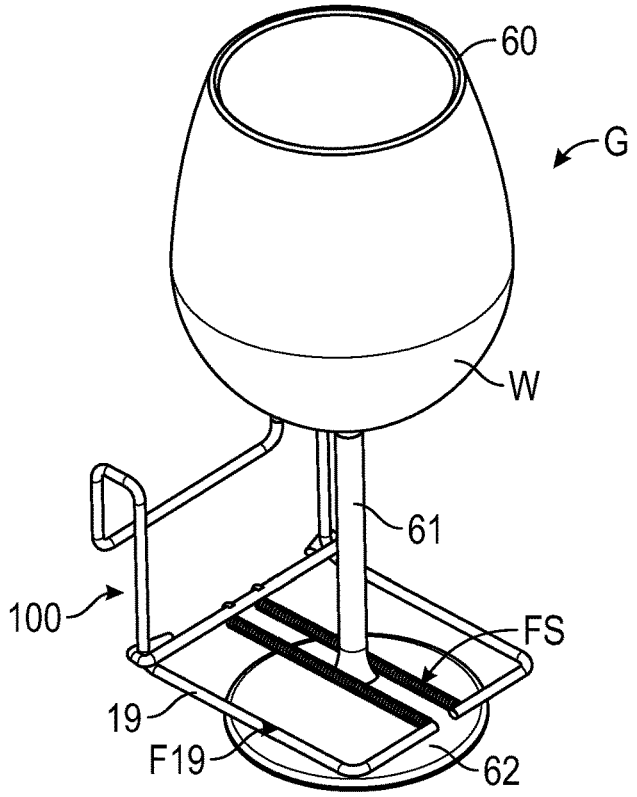
FIG. 8 is a perspective view of the wine glass holder with wine glass.
Figure 9:
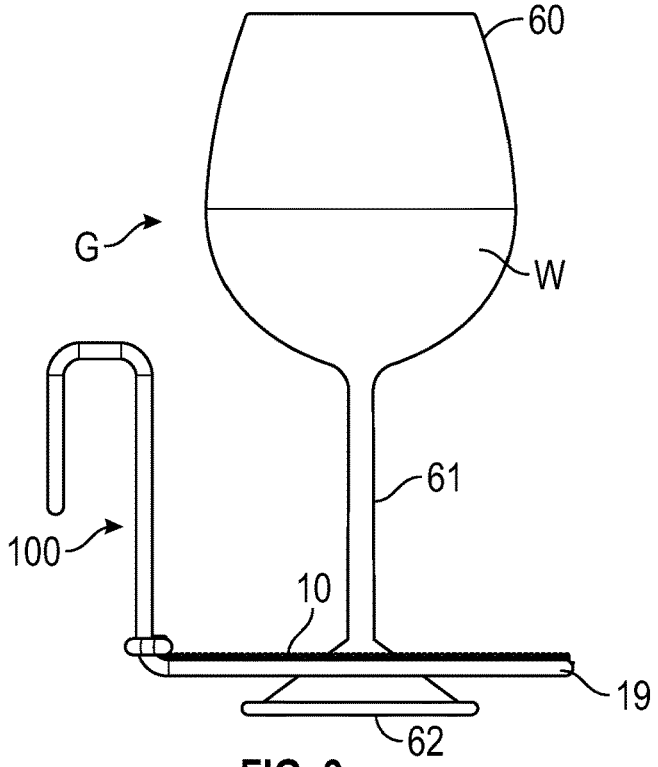
FIG. 9 is a is a left side elevation view of the wine glass holder with wine glass.

Before explaining the disclosed embodiments in detail, it is to be understood that the embodiments are not limited in application to the details of the particular arrangements shown, since other embodiments are possible. Also, the terminology used herein is for the purpose of description and not of limitation.

DETAILED DESCRIPTION OF THE PREFERRED EMBODIMENTS

Referring first to FIGS. 1-5 glass holder 100 can be constructed of two bent wires, 12 and 13. Wire 13 has a clip 14 comprising a pair vertical parts 15, a pair of outboard extensions 16, a pair of downward extensions 17 and a crossbar 18.

The base comprises a pair of legs 19 which end distally from the clip 14 with spring supports 20, 21. Springs 10, 11 are suspended from spring supports 20, 21 to a base crossbar 12, wire 12.

Preferably springs 10, 11 are parallel. Connections 23, 24 can be permanent or removable. Base crossbar 12 has end anchors 22 to stabilize the glass holder 100.

Nominal distances are:

d1=3.00 inch;
d2=2.38 inch;
d3=0.50 inch;
d4=1.07 inch;
d5=1.75 inch;
d6=0.63 inch;
d7=0.38 inch.

Referring next to FIGS. 6-9, the wine glass G has a bowl 60, a stem 61, and a base 62. It is half full of wine W. the glass holder 100 clip 14, has been clipped over a side S of tray T. Tray T may have handle recesses R. Springs 10 and 11 clasp the stem 61. The base 62 is tapered with the thickest portion at the stem. Therefore, the springs 10, 11 put a downward vector force FD on the base 62. Also, the springs put a side vector force FS on the stem 61. Also, the legs 19 put a downward vector force F19 on the base 62.

In FIG. 1 an alternate spring setup puts the springs 10, 11 shown in dots, in a V pattern with a common connection point 240 for both springs 10, 11. The further toward the side S the stem 61 is pushed, the greater the side to side force FS of the springs 10, 11 against the stem 61 becomes.

Referring next to FIGS. 10-13, holder 300 can be made of plastic and rubber or a cardboard with a rubber clamp for the stem. The clip 301 is formed to clasp onto a side S of a tray T. the tray T may have a handle H in the recess R.

Figure 10:
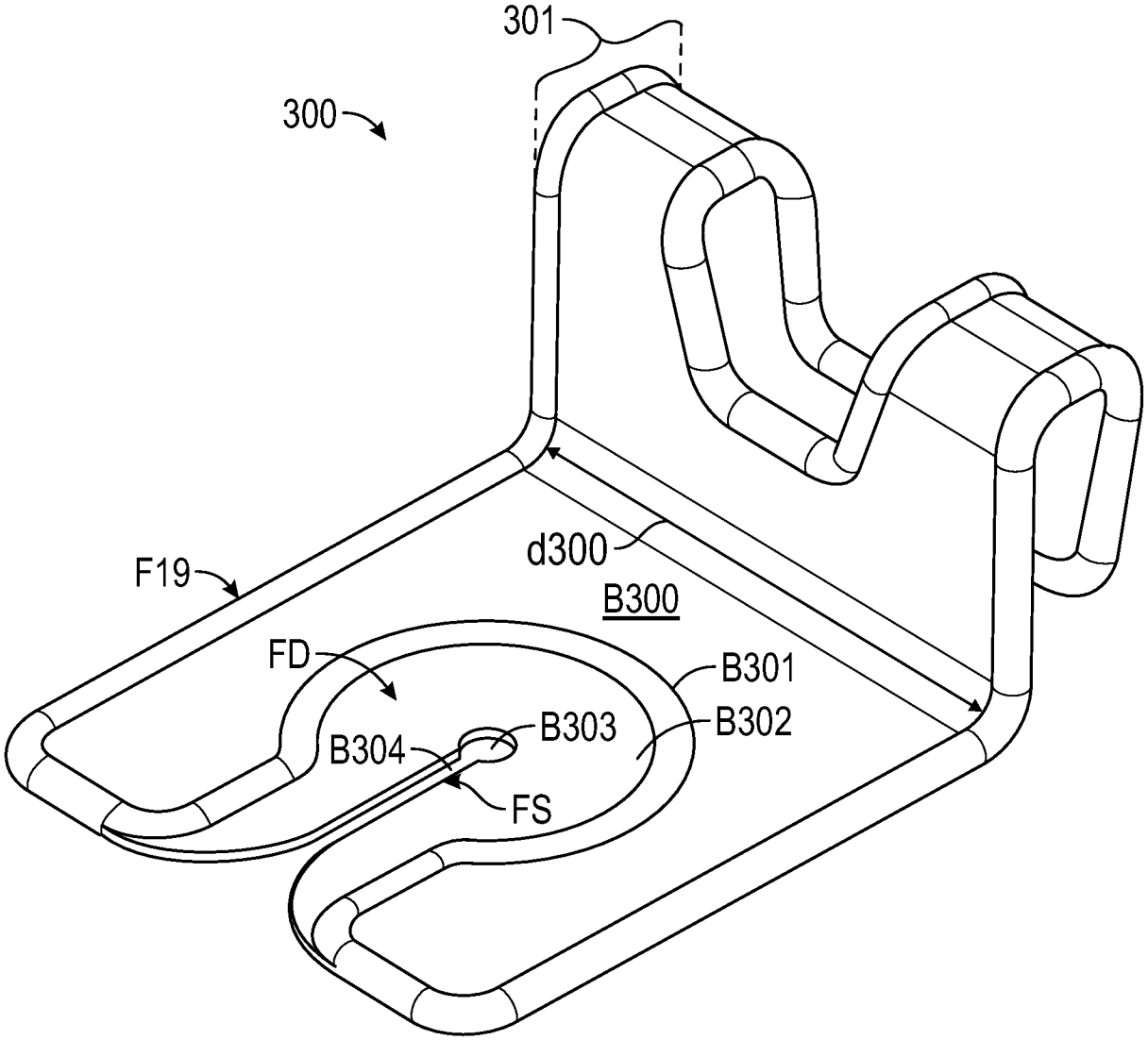
FIG. 10 is a top perspective view of a (plastic) second embodiment.
Figure 11:
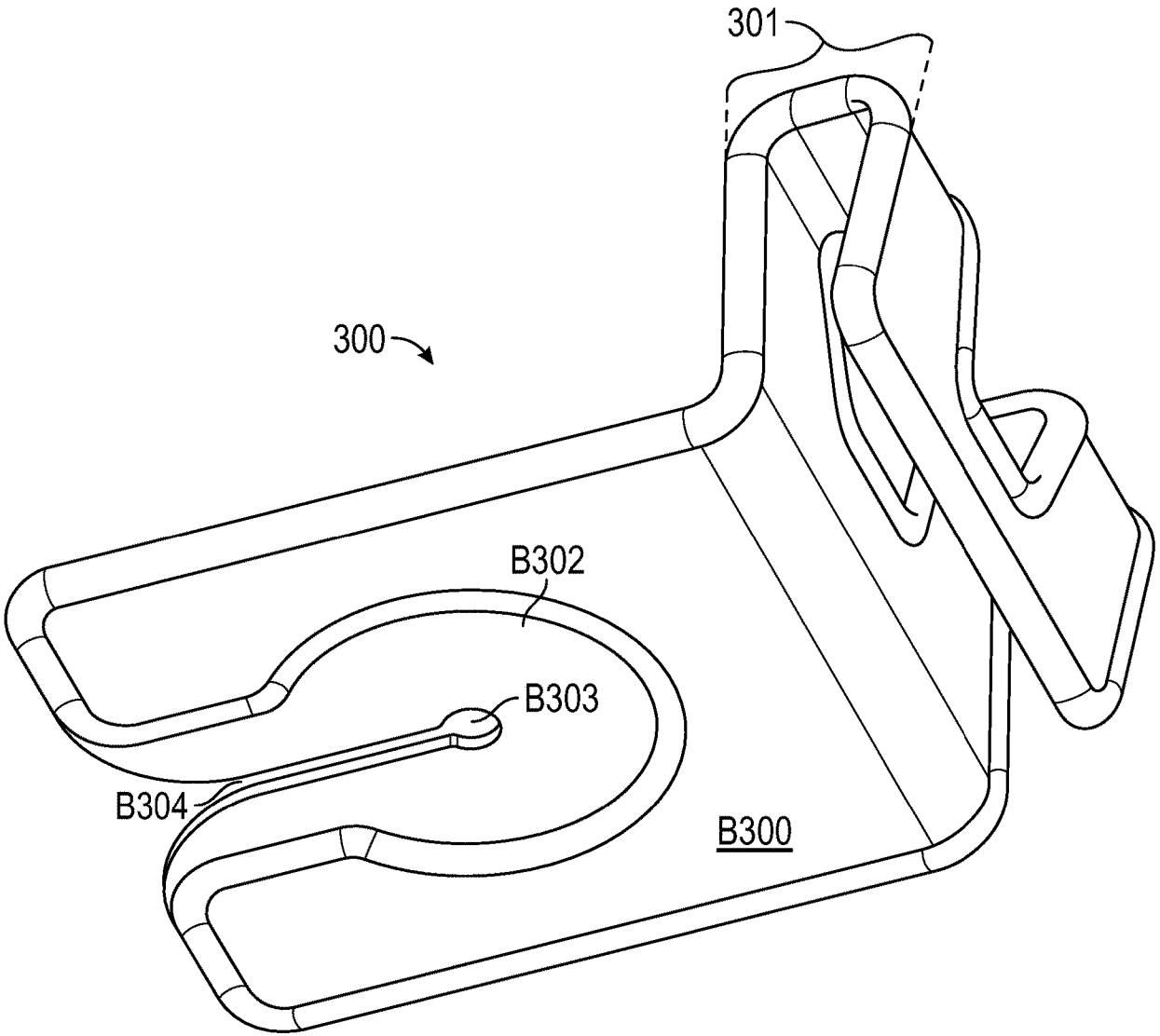
FIG. 11 is a bottom perspective view of the second embodiment.

The base B300 has a width d300 smaller than a typical 3.12 inch width of a wine glass base 62. The base B300 has a distal keyhole cutout B301. Attached in the keyhole cutout is a pliable (rubber) washer B302. The stem groove B304 ends in a stem hole B303, force down FD from the washer B302 and the side forces on the stem are shown in FIG. 10.

Figure 12:
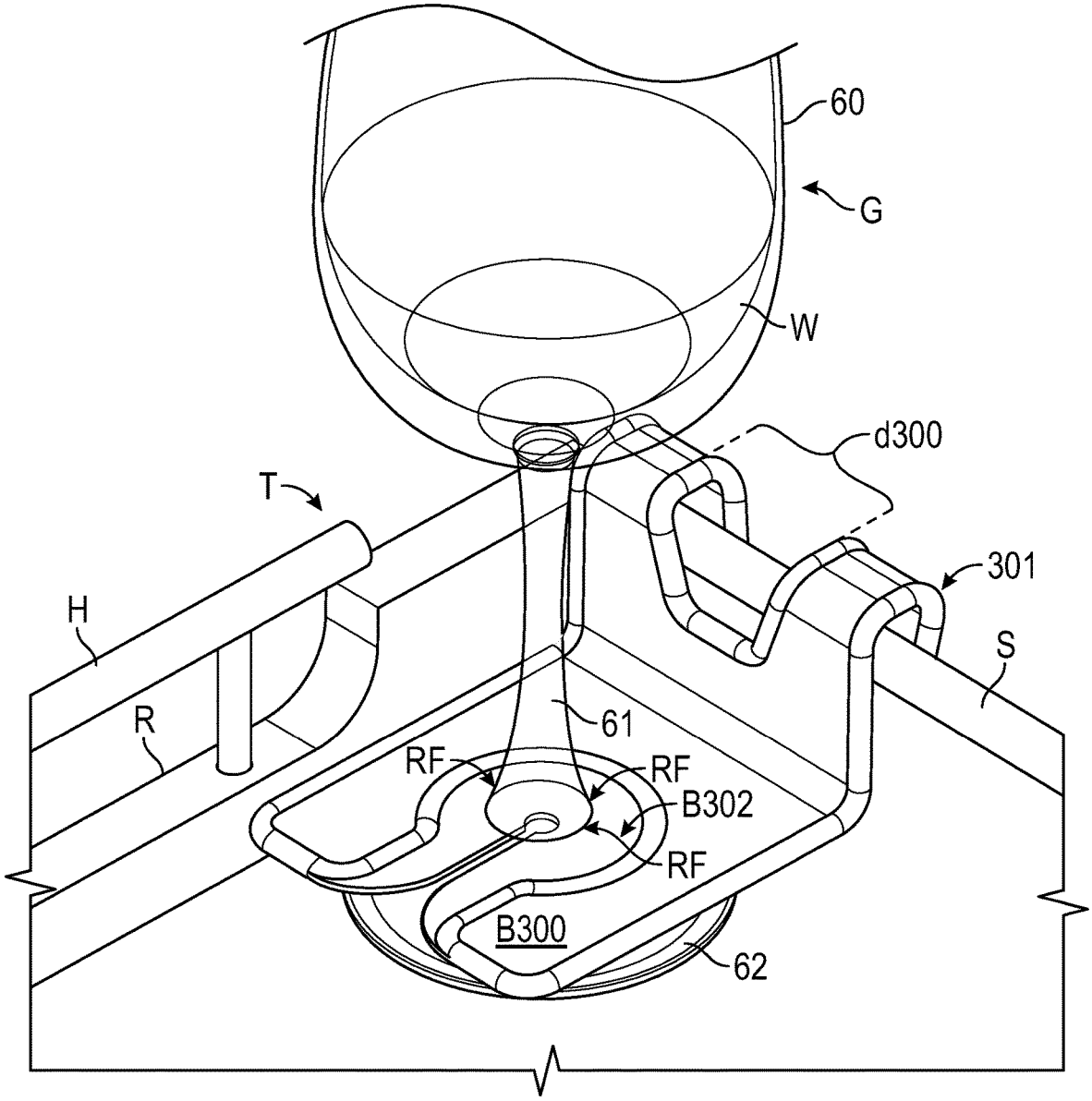
FIG. 12 is a top perspective view of the second embodiment clipped in a tray.
Figure 13:
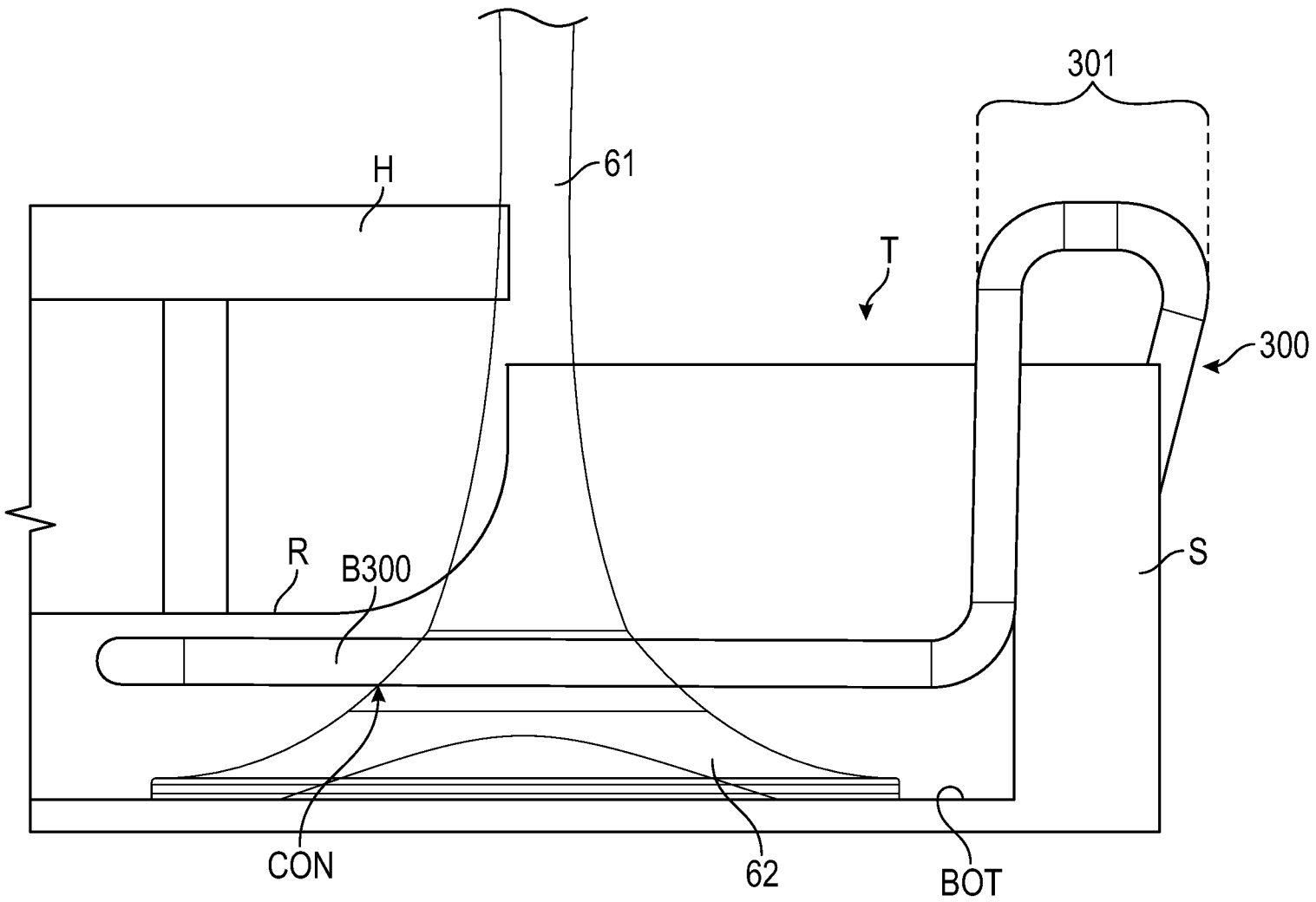
FIG. 13 is a sectional view of the second embodiment clipped in a tray.

FIG. 13 shows the glass base 62 resting on the bottom BOT of the tray T. the base B300 of the holder 300 contacts the glass base 62 at CON. FIG. 12 shows the Washer B302 exerting a radial force RF on the stem 62.

Figure 14:
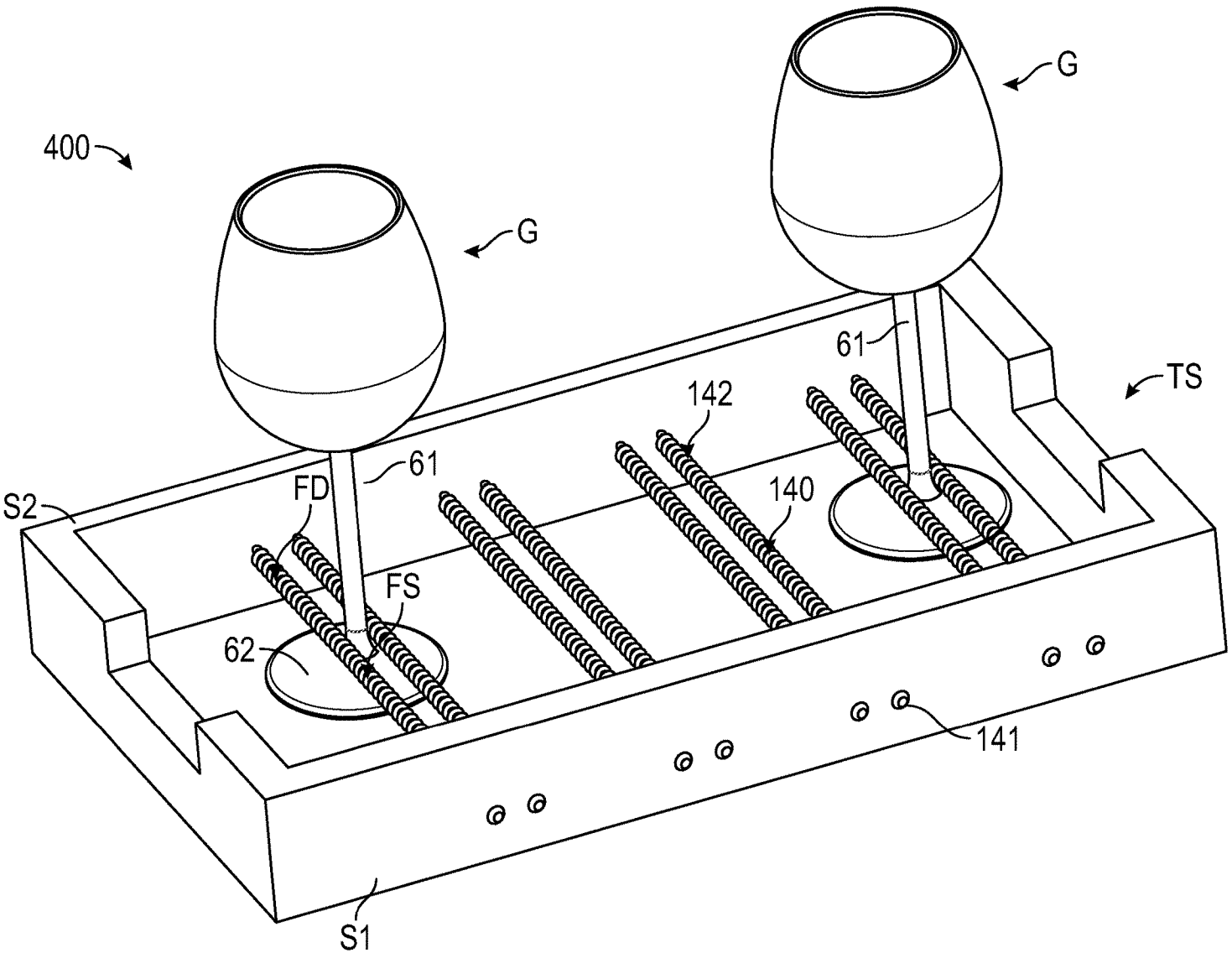
FIG. 14 is a top perspective view of a third embodiment, a tray with integral springs.

Referring next to FIG. 14, holder 400 comprises a modified tray TS. A plurality of transverse springs 140 are connected at anchors 141, 142 on opposing S1, S2. Several glasses G can be inserted at their base 62 between adjacent springs 140. These springs are tensioned to put both a downward force FD and a sideward force FS on the stem 61.

Figure 15:
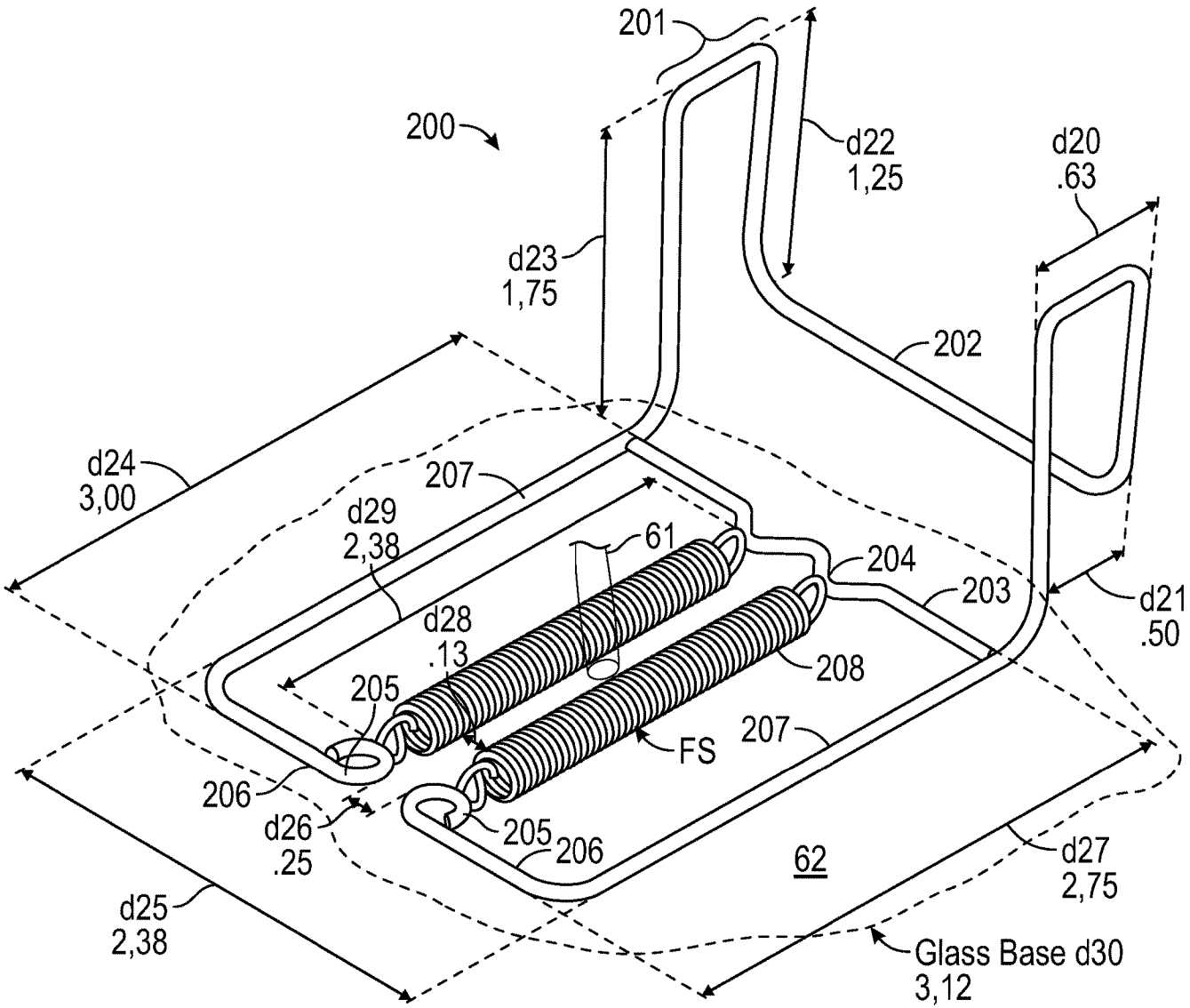
FIG. 15 is a top perspective view of the first embodiment showing an alternative spring attachment.
Figure 16:
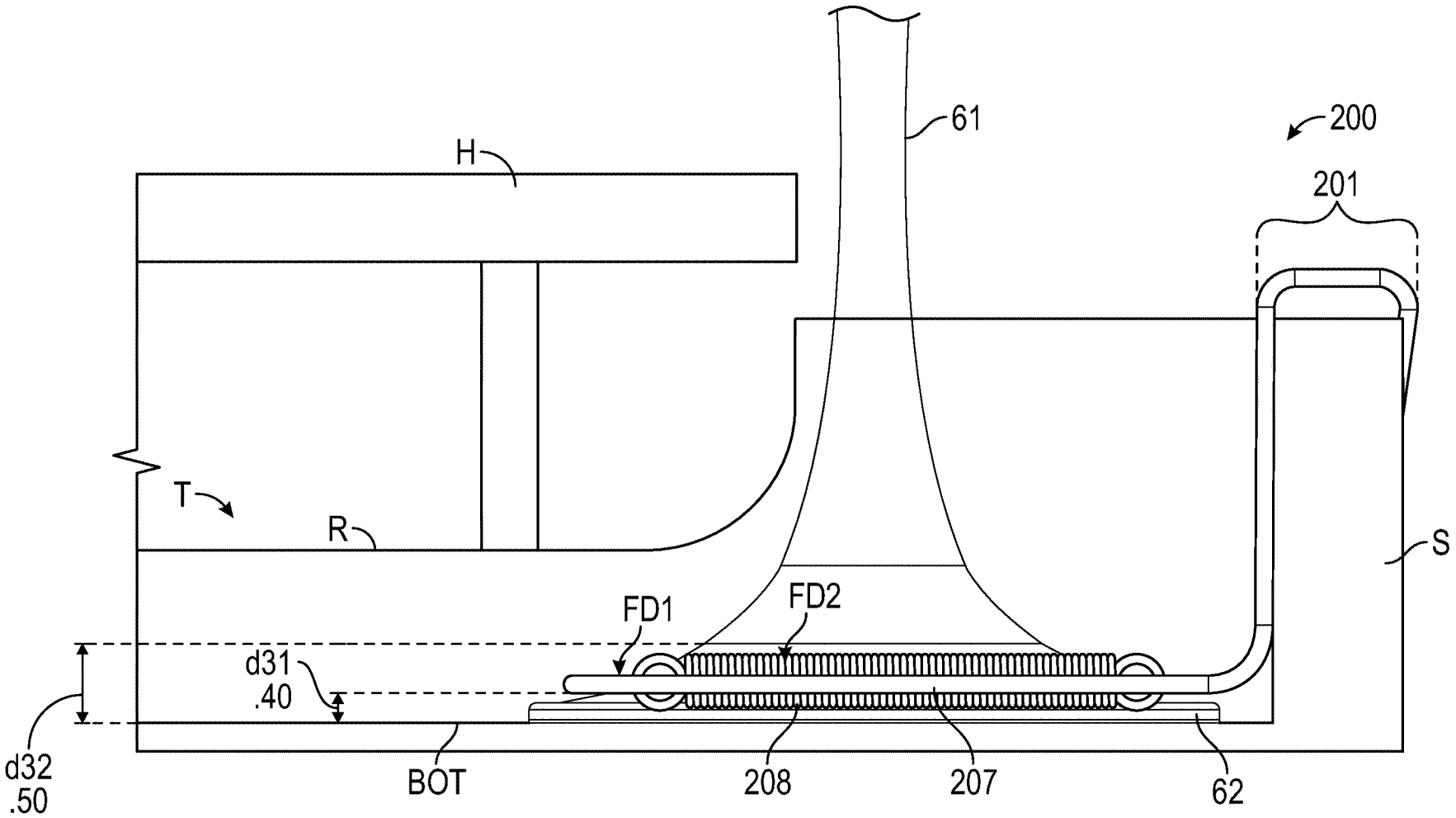
FIG. 16 is a cross sectional view of the first embodiment showing the alternative spring attachment.

Referring next to FIGS. 15, 16 holder 200 can be made of wire. The clip 201 has a crossbar 202 and clasps a side S of a traditional tray T.

Parallel base legs 207 provide a downward force FD1 on glass base 62. The (parallel) springs 208 put a second downward force FD2 on the base 62. Base legs 207 curve inward distally to form extensions 206 which end in a spring anchor 205. Nominal dimensions are:

d20=0.63 inch
d21=0.50 inch
d22=1.25 inch
d23=1.75 inch
d24=3.00 inch
d25=2.38 inch
d26=0.25 inch
d27=2.75 inch
d28=0.13 inch
d29=2.38 inch
d30=3.12 inch
d31=0.40 inch
d32=0.50 inch.

Crossbar 203 stabilizes the holder 200. Indents 204 prevent the springs 208 from sliding.

Figure 17:
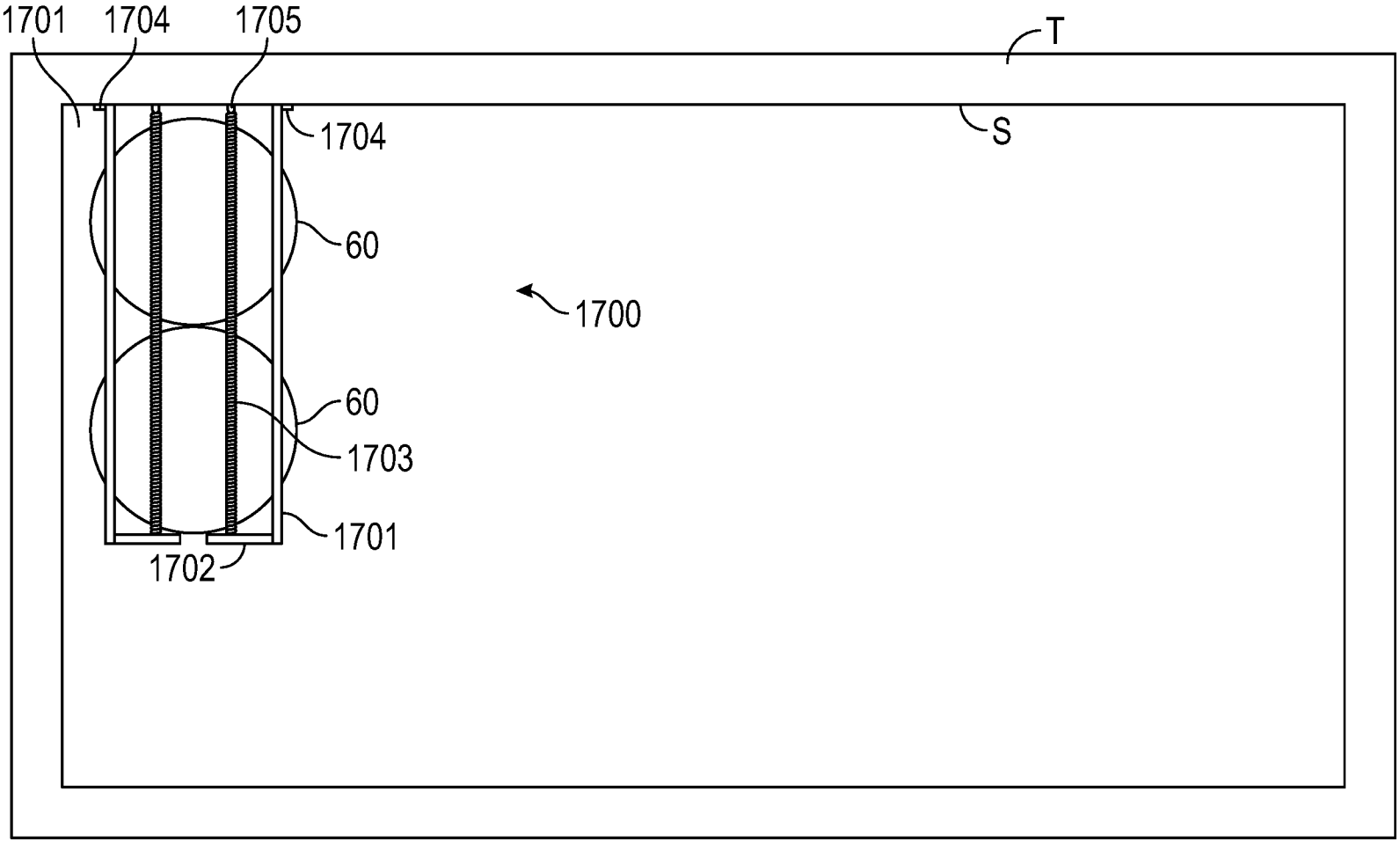
FIG. 17 is a top plan view of a bottom of the gray fifth embodiment.

Referring next to FIG. 17, holder 1700 has a pair of base legs, 1701, each screwed at 1704 to the sides of tray T. a stiff extender, 1702 points inward to the opposing extender. Each extender secures a spring, 1703 which has an opposing end, 1705 screwed into the side Sw of tray T. The springs, 1703 alternatively could be metal wires of the same width as extenders 1702. They may or may not be attached to sides.

Figure 18:
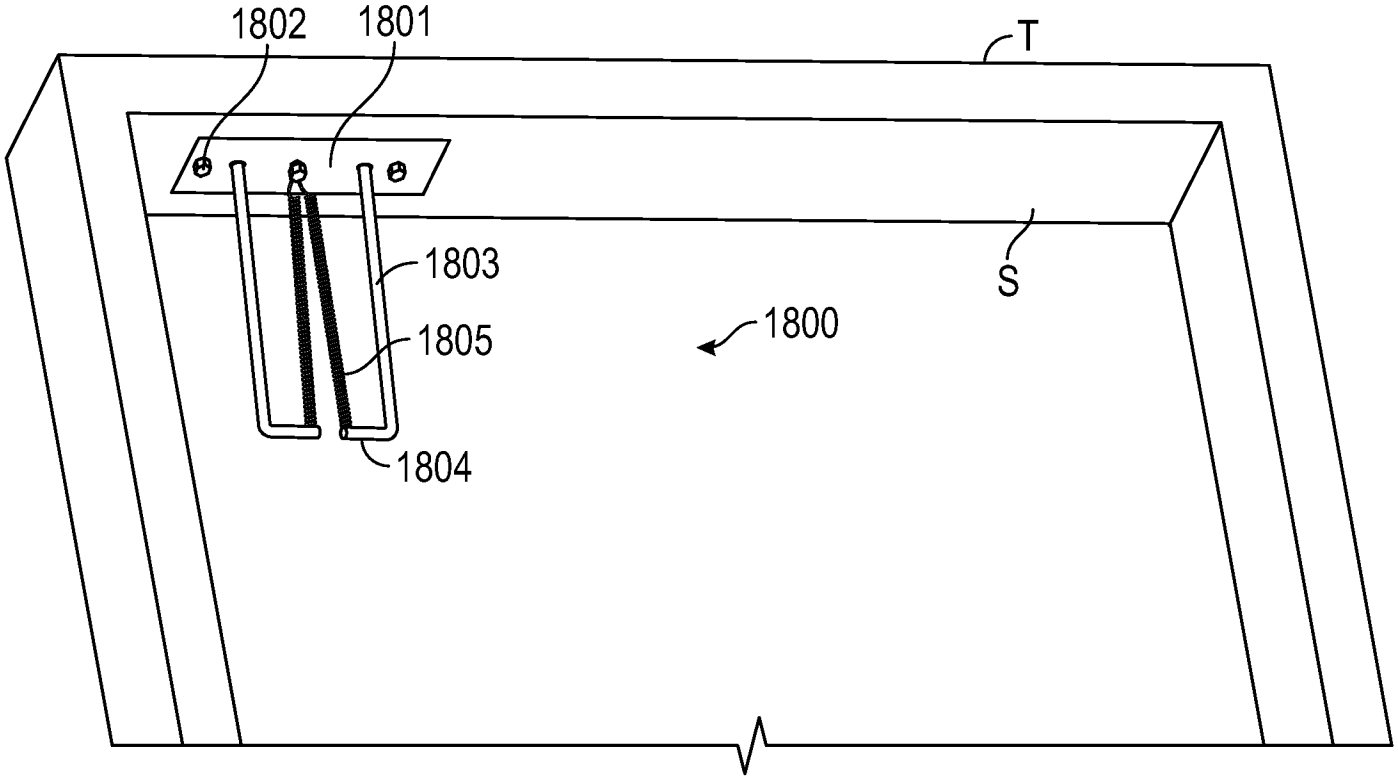
FIG. 18 is a top perspective view of a screw onto side sixth embodiment.

Referring next to FIG. 18, holder 1800 has a side bracket, 1801 secured by screws, 1802 to side s of tray T. Stiff base legs, 1803 are secured (welded) to side bracket, 1801. Extenders, 1804 face each other. Springs, 1805 are secured to the extenders. They can form a V shape as shown using a common connection point to side bracket, 1801. The springs alternatively could be stiff metal legs which may or may not be connected to side bracket 1801.

While a number of exemplifying features and embodiments have been discussed above, those of skill in the art will recognize certain modifications, permutations, additions and sub-combinations thereof. No limitation with respect to the specific embodiments disclosed herein is intended or should be inferred.

What is claimed is:

1. A drinking glass holder comprising:

a. a wall hanger having an outer wall bracket connected to an inner wall bracket via a straddle connector;

b. a left and a right base rod extending away from the inner wall bracket forming a space therebetween;

c. a tray bottom connected to the wall hanger;

d. said left and right base rods forming a gap above the tray bottom;

e. said left and right base rods each having a distal end with an extension facing inward toward an opposite base rod;

f. a flexible tether connected between each extension to the inner wall bracket; and g. wherein a stem of a drinking glass slides against the two flexible tethers and a base of the drinking glass rests in the gap under the left and right base rods so as to enable the drinking glass to remain stable when the tray is tilted.

2. The drinking glass holder of claim 1, wherein at least one flexible tether has a movable connection to a horizontal segment of the inner wall bracket so as to provide an adjustable space between the flexible tethers.

3. The drinking glass holder of claim 1, wherein both flexible tethers have a movable connection along a common horizontal segment of the inner wall bracket.

4. The drinking glass holder of claim 3, wherein each flexible tether further comprises a spring.

5. The drinking glass holder of claim 4, wherein each movable connection further comprises a hook on each spring that slides along the common horizontal segment.

6. A wine glass holder comprising:

a. a side of a tray clip;

b. said tray clip having a pair of vertical parts which are sized to reach above a bottom of tray at a height ranging from about 0.25 inch to about 0.50 inch;

c. said pair of descending arms each having a bottom end that bends to form a pair of base legs that are supported transversely above the bottom of the tray;

d. said pair of base legs each having an extender end facing each other;

e. each extender end having a spring anchor;

f. a gap sized to receive a stem of a wine glass formed between the spring anchors;

g. a spring attached to each spring anchor; and h. each spring having an opposing end attached to a crossbar mounted across the base legs.

7. The wine glass holder of claim 6, wherein the said tray clip, vertical parts, pair of base legs, and spring anchors are all formed of a single metal rod.

8. The wire glass holder of claim 7, wherein the crossbar is formed from a similar metal rod.

9. The wine glass holder of claim 8, wherein the crossbar further comprises a spring indent to prevent a movement of the spring.

10. The wine glass holder of claim 8, wherein the springs are connected to the crossbar to form a V shape.

11. The wine glass holder of claim 8, wherein the pair of descending arms are parallel to each other, and the pair of base legs are parallel to each other.

12. The wine glass holder of claim 8, wherein the gap is wider than a space between the springs.

* * * * *